United States Patent [19]

Yamamoto et al.

[11] Patent Number: 4,896,359

[45] Date of Patent: Jan. 23, 1990

[54] SPEECH SYNTHESIS SYSTEM BY RULE USING PHONEMES AS SYNTHESIS UNITS

[75] Inventors: Seiichi Yamamoto; Norio Higuchi, both of Saitama; Toru Shimizu, Tokyo, all of Japan

[73] Assignee: Kokusai Denshin Denwa, Co., Ltd., Tokyo, Japan

[21] Appl. No.: 196,169

[22] Filed: May 17, 1988

[30] Foreign Application Priority Data

May 18, 1987 [JP] Japan ..... 62-119122

[51] Int. Cl.[4] ..... G10L 5/02

[52] U.S. Cl. ..... 381/52

[58] Field of Search ..... 381/51–53, 381/36–40; 364/53.5

[56] References Cited

U.S. PATENT DOCUMENTS

| | | | |
|---|---|---|---|
| 4,278,838 | 7/1981 | Antonou | 381/52 |
| 4,685,135 | 8/1987 | Lin et al. | 381/52 |
| 4,692,941 | 9/1987 | Jacks et al. | 381/52 |

OTHER PUBLICATIONS

"Real-Time Text-to-Speech Using Custom LSI and Standard Microcomputers", James L. Caldwell, 1980 *IEEE*, pp. 43–45.

*Primary Examiner*—David L. Clark
*Assistant Examiner*—John A. Merecki
*Attorney, Agent, or Firm*—Armstrong, Nikaido, Marmelstein, Kubovcik & Murray

[57] ABSTRACT

A speech synthesizer that synthesizes speech by actuating a voice source and a filter which processes output of the voice source according to speech parameters in each successive short interval of time according to feature vectors which include formant frequencies, formant bandwidth, speech rate and so on. Each feature vector, or speech parameter is defined by two target points ($r_1$, $r_2$), and a value at each target point together with a connection curve between target points. A speech rate is defined by a speech rate curve which defines elongation or shortening of the speech rate, by start point ($d_1$) of elongation (or shortening), end point ($d_2$), and elongation ratio between $d_1$ and $d_2$. The ratios between the relative time of each speech parameter and absolute time are preliminarily calculated according to the speech rate table in each predetermined short interval.

4 Claims, 5 Drawing Sheets

SPEECH SYNTHESIS SYSTEM BY RULE USING PHONEMES AS SYNTHESIS UNITS

BACKGROUND OF THE INVENTION

The present invention relates to a speech synthesizer which synthesizes speech by combining voice source to a filter having desired characteristics. The present invention relates to such a system which synthesizes high quality of speech even when speech length and/or speech rate is adjusted.

Conventionally, a speech synthesizer stores a train of feature vectors including a plurality of formant frequencies and formant bandwidthes relating to each phoneme, and feature vector coefficients indicating change of phoneme between adjacent phonemes for every short period, for instance, 5 msec. And, an interpolation calculation has been used for obtaining transient data which are not stored between two phonemes. In that prior art, a steady state portion of a feature vector is shortened and/or elongated according to duration of each phoneme defined by a phoneme and speech rate, by omitting a data and/or repeating the same data.

However, a prior speech synthesizer has the disadvantage that synthesized speech is unnatural, because a transient portion of a phoneme is not modified even when speech rate changes.

A prior speech synthesizer has another disadvantage that the storage capacity required for storing speech data is too large, since it must store the data for every 5 msec.

SUMMARY OF THE INVENTION

It is an object, therefore, of the present invention to overcome the disadvantages and limitations of a prior speech synthesizer by providing a new and improved speech synthesizer.

It is also an object of the present invention to provide a speech synthesizer which synthesizes high quality of speech with desired speech rate.

It is also an object of the present invention to provide a speech synthesizer which requires less storage capacity for speech data.

The above and other objects are attained by a speech synthesizer system comprising; an input terminal for accepting text code including spelling of a word, together with and accent code, and an intonation code; means for converting said text code to phonetic symbol, including text string and prosodic string; a feature vector table storing speech parameters including duration of a phoneme, a pitch frequency pattern, a formant frequency, a formant bandwidth, strength of voice source, and a speech rate; a feature vector selection means for selecting an address of said feature vector table according to said phonetic symbol or distinctive features of the phonetic symbol; a speech synthesizing parameter calculation circuit for selecting a voice source and a filter which processes output of said voice source; a speech synthesizer for generating voice by actuating a voice source and a filter according to output of said speech synthesizing calculation circuit; an output terminal coupled with output of said speech synthesizer for providing synthesized speech; each of said parameters being defined by two target points ($r_1$ and $r_2$) during a phoneme, a value at each of the target points, and connection curve between the two target values; a speech rate being defined by a speech rate curve including a start point (d1) of adjustment of speech rate, an end point ($d_2$) of adjustment of speech rate, and a ratio of adjustment, stored in said feature vector table; a speech rate table generator is provided to provide relations between relative time which defines each speech parameter and absolute time, according to said speech rate curve; a speech rate table being provided to store output of said speech rate table generator; and said speech synthesizing parameter calculation circuit calculating an instant value of a speech parameter at each time defined by said speech rate table.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

The present speech synthesizer uses speech parameters including formant frequency, formant bandwidth, and strength of voice source, for defining phonemes. The number of speech parameters for each phoneme is for instance more than 40. A speech parameter which varies with time is defined for each phoneme by a target value at a pair of target positions ($r_1$, $r_2$), and a connection curve between said target points (r1 and $r_2$) Further, a speech rate of a phoneme is defined by a speech rate curve. The present invention using above parameters provides the improvement of the synthesized speech, and the capability of conversion of speech rate.

Figure 1:
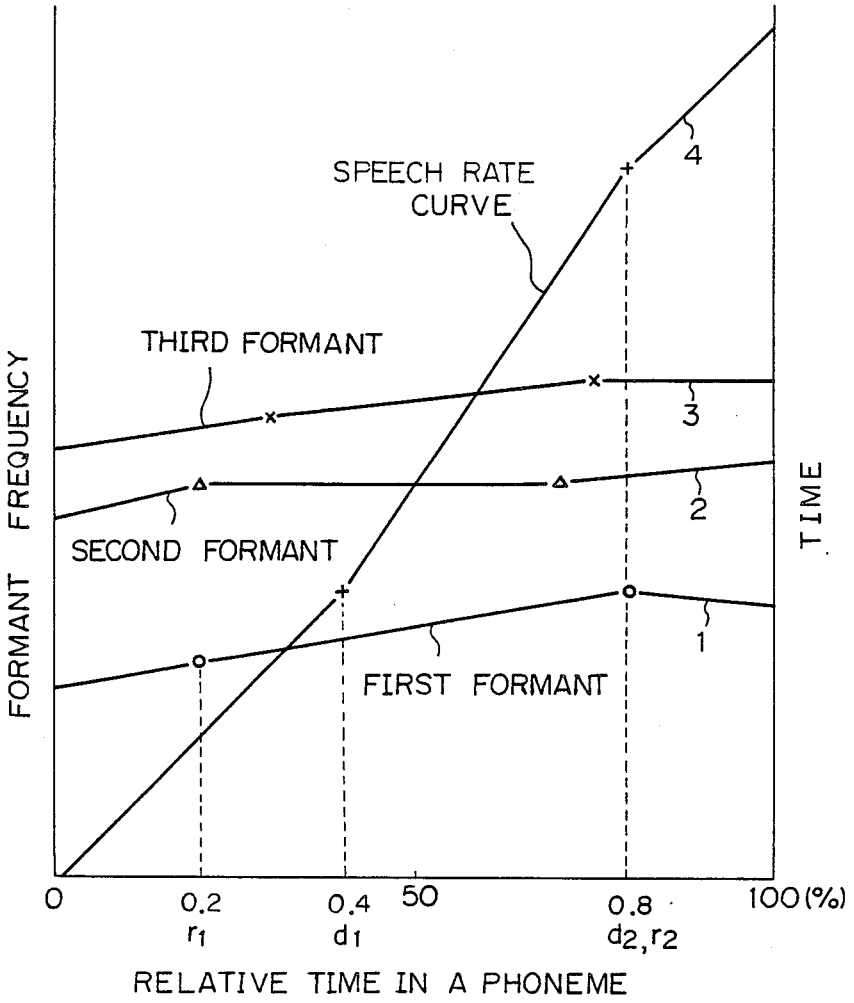
FIG. 1 show the basic idea of the present invention.

FIG. 1 shows,, curves of formant frequency which is one of the several speech parameters. In FIG. 1, the horizontal axis shows relative time of a phoneme, the left side of the vertical axis shows formant frequency, and the right side of the vertical axis shows the time. The numeral 1 shows the curve of the first formant of a phoneme, in which the target points ($r_l$ and $r_{2)\ are}$ 20% ($r_1$=0.2) and 80% ($r_2$=0.8) from the start of the phoneme, and the curve between those target points is linear. The numeral 2 and the numeral 3 show the similar curves for the second formant and the third formant, respectively. The numeral 4 shows a speech rate curve of time, in which no elongation is provided between 0 and 40%, and 80% and 100%, and the duration of speech is elongated by 1.5 times between 40% and 80% ($d_1$=0.4, and $d_2$=0.8), or speech rate is slow in that range.

A speech synthesizer requires speech parameters for every 5 msec. So, if we try to provide speech parameters for every 5 msec by using the parameters of FIG. 1, we must carry out an interpolation calculation which needs comparison calculations, multiplication calculations, and division calculations in a predetermined short duration. Therefore, we reach the conclusion that an interpolation calculation is not suitable for a speech synthesizer which requires real time operation.

The basic idea of the present invention is the use of a table which removes the interpolation calculation, even when the duration of speech (or speech rate) is shortened, or elongated.

Figure 2:
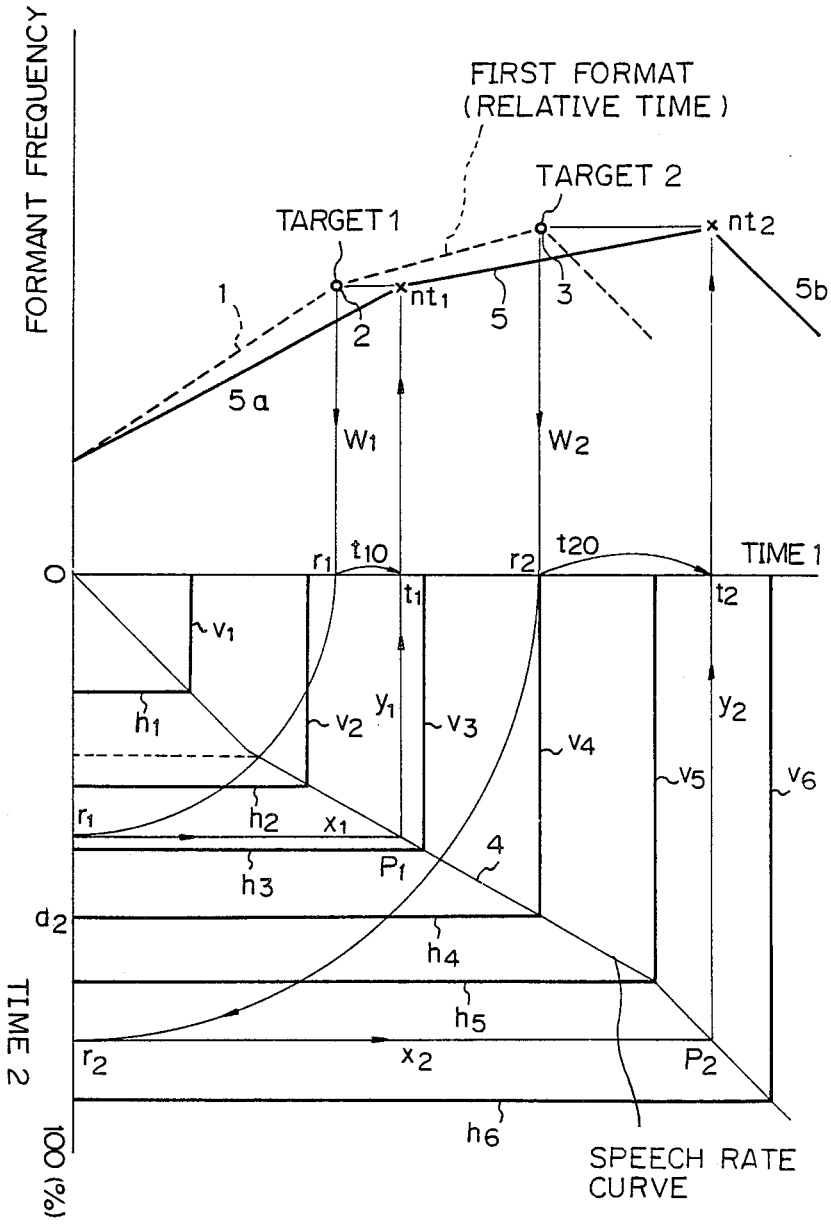
FIG. 2 shows the basic idea for generating speech rate table according to the present invention.

FIG. 2 shows the process for defining the speech rate table. In FIG. 2, the horizontal axis shows the absolute time. The upper portion of the vertical axis shows formant frequency, and the lower portion of the vertical axis shows the relative time normalized by a predetermined time duration. The lower portion of the vertical axis is the same as the horizontal axis of FIG. 1. The numeral 1 is the curve of the first formant frequency. The numerals 2 and 3 are the targets of the first formant, and numeral 4 is the speech rate curve of a phoneme, and is the same as 4 in FIG. 1.

In FIG. 2, the symbols $v_1$, $v_2$, $v_3$ . . . $v_6$ show the vertical lines for every predetermined time interval which is for instance 5 msec, and $h_1$, $h_2$, $h_3$ . . . $h_6$ are horizontal lines defined by the cross points between the speech rate curve 4, and the vertical lines $v_1$, $v_2$, $v_3$ . . . $v_6$, respectively. It should be noted that the interval between the adjacent two vertical lines $v_i$ and $v_{i+1}$ is predetermined (for instance that interval is 5 msec), and the interval between two adjacent horizontal lines $h_i$ and $h_{i+1}$ depends upon the speech rate curve 4. The location of each horizontal line shows the relative time on formant curves of FIG. 1. The speech rate, table of the present invention stores the relationships between relative time and absolute time, so that no time calculation for converting relative time to absolute time is necessary when speech with desired speech rate is synthesized. When the relative time is obtained in the speech rate table, the formant frequency at that relative time is obtained in FIG. 1 through a conventional process. When the table is prepared, the bias of an initial value due to the difference between the duration of an adjacent phoneme and the multiple time intervals must be considered.

In FIG. 2, the numeral 1 is a formant frequency curve on a relative time axis, and the numeral 4 is the speech rate curve. The numeral 5 is the modified formant frequency curve considering the adjustment of the speech rate by the curve 4. The modified formant frequency curve 5 is obtained as follows. In FIG. 2, the vertical lines $w_1$ and $w_2$ are provided from the first target point ($r_1$) 2 and the second target point ($r_2$) 3 to the horizontal axis. Then, arcs are provided from the feet of the vertical lines $w_1$ and $w_2$ to the points $r_1$ and $r_2$, respectively, on the vertical axis. Then, the horizontal lines $x_1$ and $x_2$ are provided from the points $r_1$ and $r_2$ to the points $p_1$ and $p_2$ on the speech rate curve 4. Then, the vertical lines $y_1$ and $y_2$ are provided from the points $p_1$ and $p_2$ to the points $t_1$ and $t_2$ on the horizontal axis. The points $t_1$ and $t_2$ show the absolute time of the targets 2 and 3 considering the time elongation by the curve 4. In other words, the time $t_{10}$ of the first target 2 is shifted to the time $t_1$ by the speech rate curve 4, and the time $t_{20}$ at the cross point of the vertical line $w_2$ with the horizontal axis is shifted to the time $t_2$. Therefore, the first target 2 shifts to $n_{t1}$ which is the cross point of the vertical line $y_1$ and the horizontal line from the first target 2. Similarly, the second target 3 shifts to $n_{t2}$ which is the cross point of the vertical line $y_2$ and the horizontal line from the second target 3. The solid line 5 which connects the shifted targets modified by the speech rate curve 4 shows the formant frequency curve which considers adjustment of the speech rate. The left portion 5*a* of the solid line 5 is obtained by connecting the first modified target 2 and the second modified target of the previous phoneme (not shown), and the right portion 5*b* of the solid line 5 is obtained by connecting the second target 3 and the first modified target of the succeeding phoneme (not shown).

Figure 3:
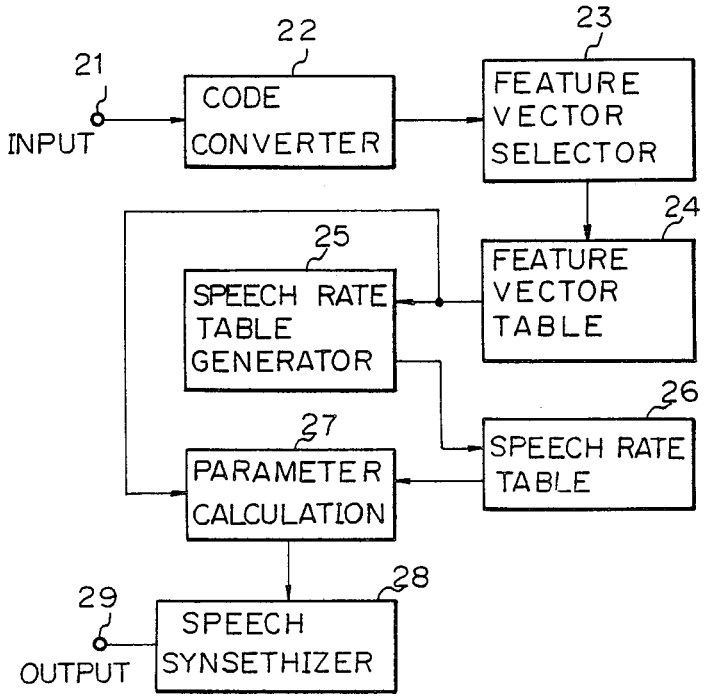
FIG. 3 is a block diagram of a speech synthesizer according to the present invention.

FIG. 3 shows a block diagram of the speech synthesizer according to the present invention. In the figure, the numeral 21 is an input terminal which receives character codes (spelling), accent symbols, and/or intonation. symbols. The numeral 22 is a code converter which provides phonetic codes according to the input spelling codes. The numeral 23 is a feature vector selection circuit which is an index file for accessing the feature vector table 24. The numeral 24 is a feature vector table which contains speech parameters including formant frequencies and duration of each phoneme. The parameters in the table 24 are defined by the target values at two target points ($r_1$ and $r_2$), and the connection curve between two targets. The example of the speech parameters is shown in FIG. 1. The numeral 25 is a speech rate table generator for generating the speech rate table depending upon the speech rate curve. The numeral 26 is the speech rate table storing the output of the generator 25.

The numeral 27 is a speech synthesizing parameter calculation circuit for providing speech synthesizing parameters for every predetermined time duration period (for instance 5 msec). The output of the circuit 27 is the selection command of a voice source, and the characteristics of a filter for processing the output of the voice source. The numeral 28 is a formant type speech synthesizer having a voice source and a filter which are selectively activated by the output of the calculation circuit 27. The numeral 29 is an output terminal for providing the synthesized speech in analog form.

It should be noted in FIG. 3 that the numerals 21, 22, 23, 27, 28 and 29 are conventional, and the portions 24, 25 and 26 are introduced by the present invention.

In operation, an input spelling code is converted to a phonetic code by the code converter 22. The output of the code converter 22 is applied to the feature vector selection circuit 23, which is an index file, and stores the address of the feature vector table 24, for each phoneme. The feature vector in the table 24 includes the information for the speech rate, the formant frequencies, the formant bandwidth, the strength of the voice source, and the pitch pattern. As described above, the formant frequencies, the formant bandwidth, and the strength of the voice source are defined by the target values at two target points in the duration of a phoneme on the relative time axis. As one item of pitch pattern information, the position of an accent core and a voice component are used (Fundamental frequency pattern and its generation model of Japanese word accent, by Fujisaki and Sudo, Nippon Accoustic Institute Journal, 27, page 445-453 (1971)).

The information of the speech rate is applied to the speech rate table generator 25 from the feature vector table 24. The speech rate table generator 25 then generates the time conversion table (speech rate table) depending upon the speech rate curve. The speech rate table generator 25 is implemented by a programmed computer, which provides the relations between absolute time and relative time depending upon the given speech rate curve. The generated values of the table is stored in the table 26. Of course, the speech rate table is obtained by a specific hardware circuit, instead of a programmed computer.

The outputs of the feature vector table 24 except the input to the speech rate table generator 25 are applied to the speech synthesizing parameter calculation circuit 27, which calculates the speech synthesizing parameters for every predetermined time duration period (for instance for every 5 msec) by using the feature vectors from the feature vector table 24 and the output of the speech rate table 26. If the target values of the formant frequencies are connected linearly, the formant frequency at the time given by the table 26 between two target points is the weighted average of the two target values. If the relative time given by the table 26 is outside of the two target positions, the formant frequency is given by the weighted average of one of the target value of the present phoneme and the target value of the preceeding (or succeeding) phoneme. The connection of the target values is not restricted to a linear line, but a sinusoidal connection, and/or cosine connection is possible. The speech synthesizing parameter calculation circuit, which is conventional, is implemented by a programmed computer. The outputs of the calculator 27, the speech synthesizing parameters for every predetermined duration (5 msec), are applied to the formant type speech synthesizer 28. The formant type speech synthesizer is conventional, and is shown for instance in "Software for a cascade/parallel formant synthesizer", J. Acoust. Am., 67b 3 (1980) by D.H. Klatt). The output of the speech synthesizer 28 is applied to the output terminal 29 as the synthesized speech in analog form.

Figure 4:
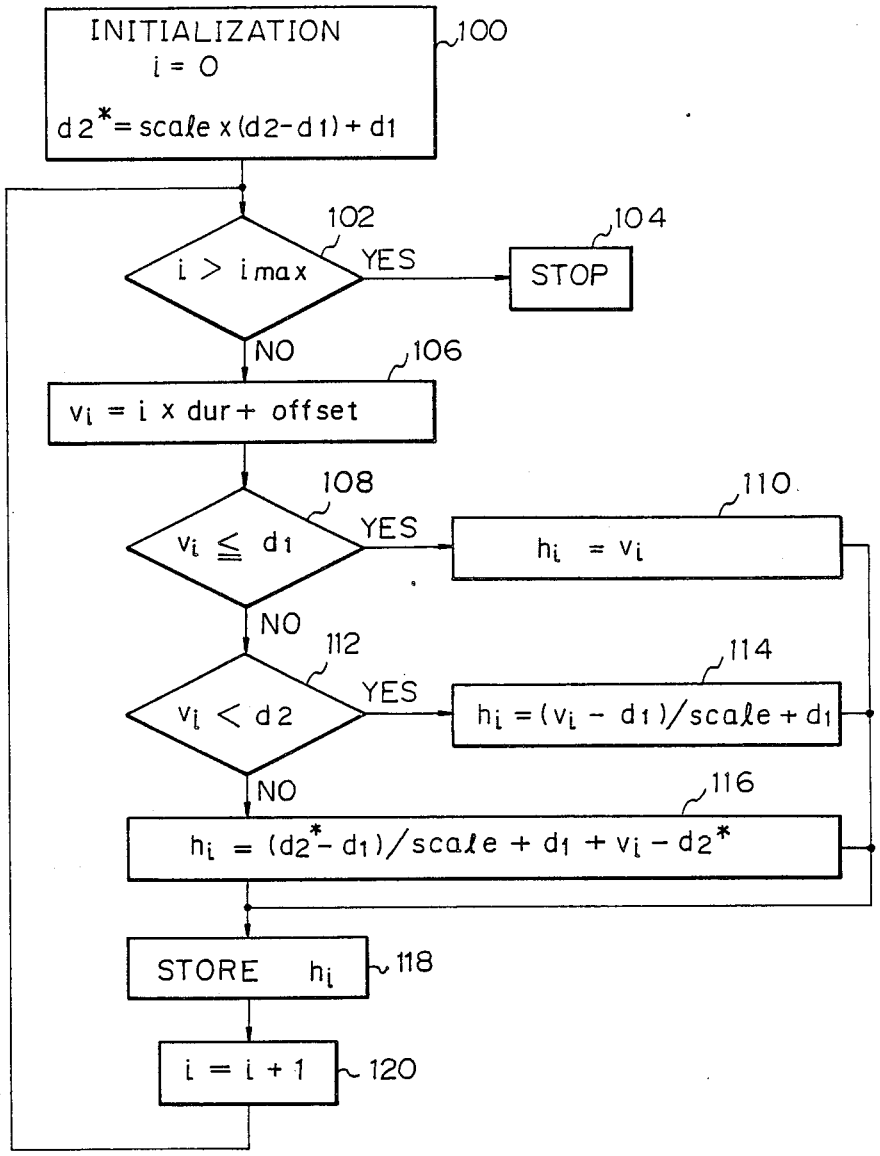
FIG. 4 is a flowchart for calculating a speech rate table.

FIG. 4 shows a flowchart of a computer for providing a speech rate table 26. The operation of the flowchart of FIG. 4 is carried out in the box 25 in FIG. 3.

In FIG. 4, the box 100 shows the initialization, in which $i=0$, and $d_2^*=\text{scale}^*(d_2-d_1)+d_1$ are set, where i shows the number of calculation, and $d_2$ and $d_2$ are start point and end point of an elongation, respectively, scale is the elongation ratio, and $d_2^*$ shows the end point of the elongation on the absolute time axis. The box 102 tests if i is larger than $i_{max}$, and when the answer is yes, the calculation finishes (box 104). When the answer in the box 102 is no, the box 106 calculates $v_i = i^*$ dur+offset, where dur is a predetermined duration for calculating speech parameters, and for instance, dur=5 msec, and offset shows the compensation of an initial value due to the bias by the connection to the preceeding phoneme. It should be noted that the value $v_i$ in the box 106 is the time interval for calculating the speech parameters.

When the value $v_i$ is equal to or smaller than $d_1$ (box 108), the relative time $h_i$ is defined to be $h_{i=vi}$ (box 110).

If the answer of the box 108 is no, and the value $v_i$ is smaller than $d_2$ (box 112), then, the relative time $h_i$ is defined to be $h_i=(v_i-d_1)/\text{scale}+d_1$(box 114).

If the answer of the box 112 is no, then, the relative time $h_i$ is calculated to be;

$h_i=(d_2^*-d_1)/\text{scale}+d_1+v_i-d_2^*$ (box 116)

Then, the value $h_i$ calculated in the boxes 110, 114 or 116 is stored in the address i of the table 26 (box 118).

The box 120 increments the value i to i+1, and the operation goes to the box 102, so that the above operation is repeated until the value i reaches the predetermined value $i_{max}$. When the calculation finishes, the table 26 stores the complete speech rate table.

Similarly, the table for taking an absolute time from a relative time is prepared in the table 26.

A speech parameter value(i) at any instant in the calculator 27 (FIG. 3) is obtained as follows.

When the time $h_i$ belongs to the same section defined by the targets ($r_1$ and $r_2$) as that of the preceeding time $h_{i-1}$, then, the speech parameter value (i) is;

$\text{value}(i)=\text{value}(i-1)+\Delta v$ where $\Delta v$ is the increment of the speech parameter, and is given by $(\text{value}(r_2)-\text{value}(r_1))/(r_2-r_1)$.

When the time $h_i$ belongs to different section from that of the preceeding time $h_{i-1}$, the absolute time of the target is obtained in the second table ($t_1$=table $2(r_1)$), and the value(i) is;

$value(i)=n_{t1}+\Delta v'(v_i-t_1)/dur$ where $\Delta v'$ is the increment in the section.

Figure 5:
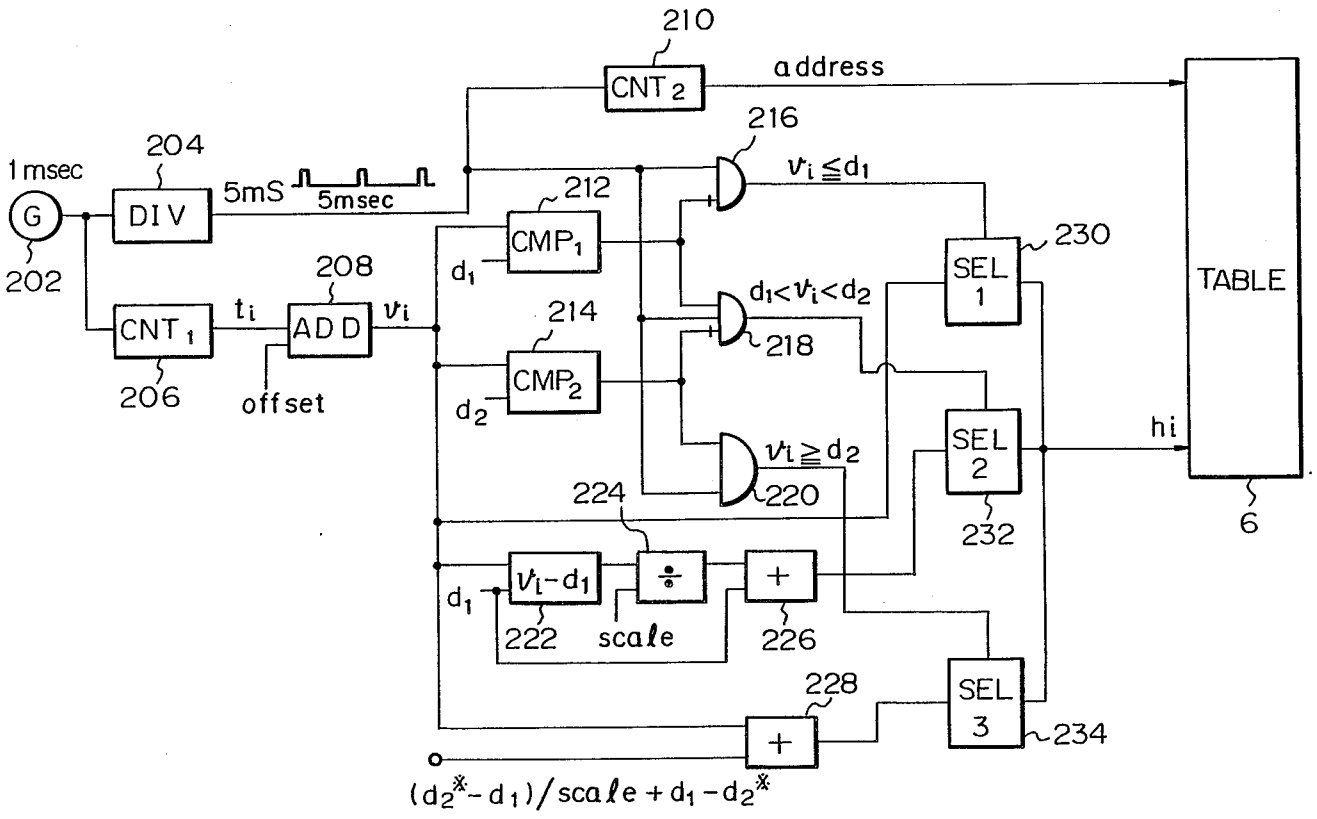
FIG. 5 is a block diagram of an apparatus for providing a speech rate table.

FIG. 5 is a block diagram of a circuit diagram of a speech rate table generator 5, and provides the same outputs as those of FIG. 4.

In FIG. 5, the numeral 202 is a pulse generator which provides a pulse train with a pulse interval 1 msec, the numeral 204 is a pulse divider coupled with output of said pulse generator 202. The pulse divider provides a pulse train with a pulse interval 5 msec. The numeral 206 is a counter for counting number of pulses of the pulse generator 202. The counter 206 provides the absolute time $t_i$. The numeral 208 is an adder which provides $v_i=t_i+\text{offset}$, where offset is the compensation of an error of an initial value.

The numeral 212 is a comparator for comparing $v_i$ with $d_1$, 214 is a comparator for comparing $v_i$ with $d_2$.

The AND circuit 216 which receives an output of the pulse divider 204 and the inverse of the output of the comparator 212 provides an output when $v_i \leqq d_1$ is satisfied. The AND circuit 218 which receives an output of the pulse divider 204, an output of the first comparator 212, and an inverse of the output of the second comparator 214 provides an output when $d_1<v_i<d_2$ is satisfied. The AND circuit 220 which receives an output of the pulse divider 204 and the output of the second comparator 214 provides an output when $v_i \geqq d_2$ is satisfied.

The numeral 222 is a subtractor which receives $v_i$ (output of the adder 208), and $d_1$, and provides the difference $v_i-d_1$, the divider 224 coupled with output of said subtractor 222 provides $(v_i-d_1)/\text{scale}$, and the adder 226 coupled with the output of the divider 224 and $d_1$ provides $(v_i-d_1)/\text{scale}+d_1$.

The adder 228 which receives $v_i$ which is the output of the adder 208, and the constant $(d_2^*-d_1)/\text{scale}+d_1-d_2^*$ provides $(d_2^*-d_1)/\text{scale}+d_1-d_2^*+v_i$.

The selector 230 provides an output $v_i$ when the AND circuit 216 provides an output.

The selector 232 provides the output of the adder 226 when the AND circuit 218 provides an output.

The selector 234 provides the output of the adder 228 when the AND circuit 220 provides an output.

The outputs of the selectors 230, 232, and 234 are applied to the table 26 to supply it the data, and the address for storing the data in the table 26 is supplied by the counter 210, which counts the output of the pulse divider 204.

Therefore, the circuit of FIG. 5 operates similar to the flowchart of FIG. 4.

It should be noted that a speech rate curve is defined for each phoneme, and is common to all the speech parameters in the given phoneme. Further, the target points ($r_1$, $r_2$) of the speech parameters are different from the target points of other speech parameter, and of course different from the start and end ($d_1$ and $d_2$) of speech rate curve.

From the foregoing, it will now be apparent that a new and improved speech synthesis system has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A speech synthesis system comprising:

code converter means (22) for accepting at an input terminal (21) text code comprising spelling, accent code and intonation code of a word, and producing therefrom a phonetic symbol for pronunciation (phoneme of speech) including a text string and aprosodic string for each phoneme of speech;

a feature vector table (24) including means for storing feature vector information comprising speech parameters for each phoneme, including a time duration period, pitch frequency pattern, formant frequency, formant bandwidth, strength of a voice source, and speech rate, wherein each of said speech parameters is defined by two target points ($r_1$ and $r_2$) during said time duration period, a value at each of the target points, and a connection curve between said two target point values, and wherein said said speech rate is defined for each phoneme by parameters of a speech rate adjustment curve including a start point ($d_1$), an end point ($d_2$) and a ratio of adjustment, stored in said feature vector table (24);

feature vector selection means (23) for selecting an address of said feature vector table (24) in accordance with each phonetic symbol input thereto from said code converter means (22);

a speech rate table generator means (25) for calculating, in response to speech rate parameters stored in said address selected from said feature vector table (24) by said selection means (23), a relationship between relative time which defines a speech parameter and absolute time, according to said speech rate adjustment curve;

a speech rate table (26) for storing the output of said speech rate table generator means (25) for successive short increments of time defined by said generator means (25);

speech synthesizing parameter calculation means (27) for calculating, from feature vector information stored in said feature vector table (24) and speech rate information stored in said speech rate table (26), an instant value of a speech parameter at each increment of time defined in said speech rate table (26);

speech synthesizer means (28) including voice sources and filters for generating a synthesized voice output by actuating voice source and filter combinations according to said speech parameter values calculated by said speech synthesizer parameter calculation means (27); and an output terminal (29) coupled with an output of said speech synthesizer means (28) for providing said synthesized speech.

2. A speech synthesis system according to claim 1, wherein said connection curve between said two target point values is linear.

3. A speech synthesis system according to claim 1, wherein target points ($r_1$, $r_2$) of a speech parameter differ from target points of other speech parameters in a phoneme.

4. A speech synthesis system according to claim 1, wherein said start point ($d_1$) and end point ($d_2$) differ from target points ($r_1$, $r_2$) of each speech parameter.

* * * * *